US008215283B2

(12) United States Patent
Warchuck

(10) Patent No.: US 8,215,283 B2
(45) Date of Patent: Jul. 10, 2012

(54) COOLING SYSTEM FOR VARIABLE CYLINDER ENGINES

(75) Inventor: Dennis Charles Warchuck, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 616 days.

(21) Appl. No.: 12/418,752

(22) Filed: Apr. 6, 2009

(65) Prior Publication Data

US 2010/0251977 A1 Oct. 7, 2010

(51) Int. Cl.
*F02D 13/06* (2006.01)
*F02D 17/02* (2006.01)
*F01P 7/14* (2006.01)

(52) U.S. Cl. ..... 123/198 F; 123/41.08; 123/41.29; 123/41.02

(58) Field of Classification Search ..... 123/41.1, 123/41.29, 198 F
See application file for complete search history.

(56) References Cited

U.S. PATENT DOCUMENTS 2,675,789 A 4/1954 Watkins et al.
4,436,060 A 3/1984 Tanaka et al.
5,487,363 A * 1/1996 Batzill et al. ..... 123/41.74
5,937,802 A * 8/1999 Bethel et al. ..... 123/41.74
6,055,947 A * 5/2000 Okuno ..... 123/41.13
6,595,164 B2 7/2003 Kunze et al.
6,640,543 B1 * 11/2003 Seal ..... 60/609
6,786,191 B2 * 9/2004 Foster ..... 123/198 F
6,837,194 B2 1/2005 Banzhaf et al.
7,047,913 B2 5/2006 Werner et al.
7,168,398 B2 1/2007 Ap et al.
7,207,298 B2 * 4/2007 Lee ..... 123/41.29
7,236,875 B2 * 6/2007 Bevan et al. ..... 701/113
7,263,954 B2 * 9/2007 Piddock et al. ..... 123/41.09
7,334,545 B2 * 2/2008 Müller ..... 123/41.31
7,455,239 B2 * 11/2008 Braun et al. ..... 236/34
7,966,978 B2 * 6/2011 Maehara et al. ..... 123/41.29
2002/0174840 A1 * 11/2002 Luckner et al. ..... 123/41.1
2003/0196612 A1 * 10/2003 Le Lievre et al. ..... 123/41.1
2004/0011304 A1 * 1/2004 Herynek et al. ..... 123/41.1

* cited by examiner

*Primary Examiner* — Noah Kamen
*Assistant Examiner* — Grant Moubry
(74) *Attorney, Agent, or Firm* — Plumsea Law Group, LLC; Mark E. Duell

(57) ABSTRACT

A cooling system for variable cylinder engines is is designed to most efficiently cool engine during engine full displacement operation and to heat inactive cylinders and cool active cylinders during engine reduced displacement operation. By heating inactive cylinders, the fuel efficiency during reactivation is improved and the optimal operation of the catalytic converter may be maintained.

20 Claims, 5 Drawing Sheets

COOLING SYSTEM FOR VARIABLE CYLINDER ENGINES

BACKGROUND

This invention relates to cooling systems for internal combustion engines, and, more specifically, dynamic cooling systems for internal combustion engines with variable cylinder management.

Internal combustion engines generally require some form of fuel to provide energy for combustion. It is desirable to improve the fuel efficiency of these engines by reducing the engine displacement during times of low load requirements on the engines. Engine displacement is reduced by temporarily suspending operation of some cylinders within the engine. Engine operation with reduced displacement will reduce the amount of fuel consumption compared to engine operation utilizing all cylinders.

The internal combustion process of generating energy for engine operation produces some amount of gaseous byproducts that are carried away from the engine by the exhaust system. In order to properly manage the contaminants present in the combustion byproduct exhaust, the exhaust is treated with a catalytic converter prior to being released to the environment. A catalytic converter includes a catalyst that reacts with the exhaust to reduce the amount of pollutants, such as NOx, expelled in the exhaust. Catalytic converters generally operate most effectively in a certain optimal temperature range. When the exhaust gases entering the catalytic converter either heat or cool the catalytic converter away from the optimal temperature range, the performance of the catalytic converter degrades.

Internal combustion engines, by their nature, generate heat during operation. These engines require temperature regulation of the engine cylinder banks where the combustion occurs to provide for efficient operation and to prevent overheating. Typically, a cooling system is used to regulate the temperature of the engine. In variable cylinder engines, utilization of the cooling system may cause overcooling of the inactive cylinders, thus reducing efficiency of combustion upon reactivating the cylinders that were inactive during reduced displacement. Additionally, cooling of the engine will result in cooling of engine exhaust, which may result in suboptimal operation of the catalytic converter.

In some conventional systems, the cooling system for a multiple-bank engine may be configured such that it cools both banks of engine cylinders in parallel. This provides extremely efficient cooling when both banks of cylinders are firing. However, when one or more banks of cylinders are inactive, a parallel cooling configuration may be less than ideal, as cooling an inactive bank is superfluous. In other conventional systems, the heating and cooling system may be configured in a variable cylinder engine such that the system heats the first cylinder bank in series with the second engine bank. Using this configuration, engine coolant acts to cool first active engine bank and heat the second inactive engine bank during low engine load conditions. Heating the inactive engine bank allows the inactive engine bank begin combusting more efficiently when the load on the engine increases such that it is desirable for all cylinders to fire. However, when all cylinders are firing, series cooling may lead to inefficient or insufficient cooling of the subsequent banks of cylinders.

U.S. Pat. No. 4,436,060 to Tanaka et al., which is hereby incorporated by reference in its entirety, describes heating inactive engine cylinders by heating two engine banks in series. The Tanaka design is suitable for variable cylinder engines during operation in a reduced displacement configuration. In the Tanaka design, the heat extracted from the first engine bank containing actively firing cylinders is transferred to the second engine bank containing inactive cylinders. By transferring heat to the second engine bank, the cylinders remain at a temperature suitable for stable combustion upon reactivation of the cylinders.

The limitation to this design occurs during the full displacement configuration of the engine when all cylinders are actively firing. The engine coolant will efficiently extract heat from the first engine bank, but will have a reduced ability to extract heat from the second engine bank due to the temperature elevation from passing through the first engine bank. As a result, the second engine bank will operate at a higher temperature than the first engine bank. This can lead to damage or increased wear of engine parts sensitive to temperature, such as the fuel valves.

Other solutions to modifying the cooling process of variable cylinder engines are described by Werner et al. in U.S. Pat. No. 7,047,913 and by Watkins et al. in U.S. Pat. No. 2,675,789, both of which are incorporated by reference in their entirety. Both the Werner design and the Watkins design describe reducing the cooling capacity of the engine cooling system during times of reduced displacement operation of the engine. Neither of these designs describe a means for heating the inactive cylinders to improve both fuel efficiency and catalytic converter efficiency.

There is a need in the art for an efficient heating and cooling system for variable cylinder engines that provides the most efficient means of cooling engine during full displacement operation and a means for most efficient heating of inactive cylinders during reduced displacement operation.

SUMMARY OF THE INVENTION

A cooling system for an internal combustion engine is disclosed.

In one aspect, the invention provides a cooling system for an internal combustion engine having a plurality of engine cylinders, comprising a cooling circuit that includes a first flowpath for transferring an engine coolant to the engine cylinders in parallel and a second flowpath for transferring the engine coolant to the engine cylinders in series.

In another aspect, either the first flowpath or the second flowpath is dynamically selected.

In another aspect, the cooling circuit comprises a system of fluidly connected conduits and at least one control valve capable of selecting either the first flowpath or the second flowpath.

In another aspect, the internal combustion engine is a variable cylinder engine.

In another aspect, the first flowpath is selected when the internal combustion engine is operating at full displacement.

In another aspect, the second flowpath is selected when the internal combustion engine is not operating at full displacement.

In another aspect, the cooling system includes a radiator for removing heat from the engine coolant, wherein the cooling circuit transfers the engine coolant from the engine cylinders to the radiator.

In another aspect, the invention provides a cooling system for a variable cylinder engine, comprising a radiator for removing heat from the cooling system, a system of fluidly connected conduits for circulating an engine coolant to and from the radiator to a plurality of engine cylinders, the system of fluidly connected conduits forming a first cooling circuit that cools the plurality of engine cylinders in parallel, the system of fluidly connected conduits forming a second cooling circuit that cools a first set of cylinders prior to heating a second set of cylinders when the second set of cylinders are inactive, and a control valve to direct the engine coolant to flow through either the first cooling circuit or through the second cooling circuit depending on a displacement state of the variable cylinder engine.

In another aspect, the first cooling circuit is selected when the displacement state is full displacement.

In another aspect, the second cooling circuit is selected when the displacement state is any displacement state other than full displacement.

In another aspect, the second set of cylinders is inactive.

In another aspect, the engine coolant transfers heat from the first set of cylinders to the second set of cylinders.

In another aspect, heating the second set of cylinders maintains an exhaust temperature of an exhaust produced by the first set of cylinders at levels sufficient to maintain catalytic conversion of the exhaust.

In another aspect, heating the second set of cylinders maintains a cylinder temperature of the second set of cylinders at levels sufficient for efficient reactivation of the second set of cylinders.

In another aspect, the variable cylinder engine is a V-type engine.

In another aspect, the displacement state is selected based on an engine load.

In another aspect, the invention provides a method for cooling an internal combustion engine having a plurality of cylinders comprising (i) determining if all of the cylinders are firing, (ii) selecting a parallel cooling flowpath for all or substantially all of the cylinders if all of the cylinders are firing, and (iii) selecting an in series cooling flowpath so that a first set of cylinders is cooled prior to a second set of cylinders if fewer than all cylinders are firing.

In another aspect, the parallel cooling flowpath and the in series cooling flowpath are selected by manipulating at least one valve disposed within a system of fluidly connected conduits, the system of fluidly connected conduits containing both the parallel cooling flowpath and the in series cooling flowpath.

In another aspect, a controller determines whether all of the cylinders are firing and manipulates the at least one valve.

In another aspect, the controller comprises an on board computer of a motor vehicle.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
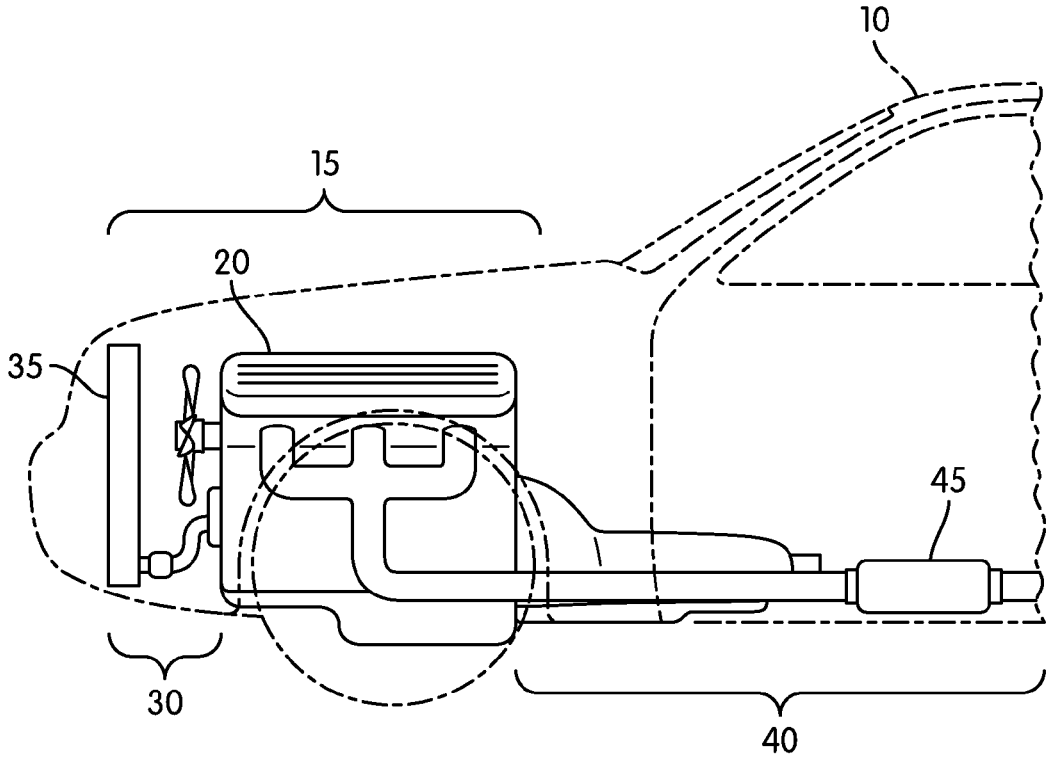
FIG. 1 is a side view of a portion of a motor vehicle having an internal combustion engine, a cooling system and an exhaust system.

The invention is related to a cooling system for the engine of a motor vehicle. Referring to FIG. 1, a motor vehicle 10 includes an engine 20, a cooling system 30 to maintain the operating temperature of engine 20, and an exhaust system 40 for eliminating waste gases and pollutants produced by engine 20. Motor vehicle 10 may be any type of motor vehicle known in the art, but may be an automobile having an engine compartment 15 configured to receive engine 20. In some embodiments, engine 20 is an internal combustion engine.

Generally, internal combustion engines include cylinders containing pistons for creating combustion and harnessing combustion energy. Typically, a mix of fuel and air is injected into the cylinders. The fuel and air mix is subsequently compressed within the cylinders by the pistons. Once a specified compression of the fuel and air mix is achieved, a spark is introduced into each cylinder to ignite the fuel. The fuel combusts in combination with the oxygen from the air supplied into the cylinders producing force on the pistons as well as heat and exhaust byproducts.

The force generated by the combustion energy is applied on pistons disposed within the cylinders. The pistons are displaced within the cylinders when exposed to the force. The pistons are mechanically linked, usually with a crankshaft, such that piston displacements may be harnessed by the engine for locomotion of motor vehicle 10. The exhaust gases are simultaneously expelled from the cylinder into exhaust system 40. In some embodiments, exhaust byproducts are released to the environment directly from engine 20 through exhaust system 40. However, exhaust may be subsequently passed through a catalytic converter 45 to reduce contaminants before the exhaust is released to the environment.

The heat produced by the combustion within the cylinders heats the cylinders. Cooling system 30 is used to cool the cylinders to help prevent damage to the cylinders and to maintain efficient combustion. Engine 20 may undergo temperature regulation during operation. In one embodiment, cooling system 30 disposed within engine compartment 15 is used to regulate the temperature of engine 20.

In some embodiments, cooling system 30 comprises a radiator 35 disposed within engine compartment 15. Radiator 35 provides an efficient means for extracting heat from engine coolant and releasing the heat to the environment. Cooling system 30 generally includes a series of conduits, and a pump may be used to circulate engine coolant through internal combustion engine 20 and radiator 35. Engine coolant is circulated through engine 20 via a series of conduits and delivered to radiator 35 for re-cooling by allowing the heat in the coolant to dissipate to the atmosphere.

Engine coolant is a fluid that is circulated through engine 20 to extract heat generated by the combustion occurring in engine cylinders. Engine coolant may be any type of coolant known in the art, such as a liquid, a suspension, a gel, or a gas. Engine coolant typically includes water, a liquid alcohol such as ethylene glycol, or some combination of water and alcohol.

Engine 20 may be an internal combustion engine having multiple cylinders. Additionally, engine 20 may be configured such that cylinders are disposed within engine 20 and oriented in a straight line relative to each other. In some embodiments, engine 20 is a configured such that cylinders are oriented in a V-shape relative to each other. In the V-shape configuration, half of the cylinders may be disposed within a first cylinder bank oriented along one leg of the V-shape and the other half of the cylinders may be disposed within a second cylinder bank oriented along the other leg of the V-shape. In some embodiments, engine 20 may be configured with any number of cylinders, including two, thee, four, five, eight, ten, or twelve. In the embodiment shown in the figures, engine 20 is configured with six cylinders arranged into two banks. In other embodiments, engine 20 is a V6 cylinder configured engine. In one embodiment, engine 20 is a V6 cylinder configured engine with variable cylinder management.

Variable cylinder management generally refers to the ability of an engine to reduce the number of active engine cylinders. Active cylinders are cylinders that are fully operational and are being supplied with fuel and air and subsequently igniting the fuel. This process provides the energy for engine operation. An inactive cylinder is a cylinder whose operation has been suspended in some way, so that no combustion is occurring within the cylinder.

A variable cylinder engine is designed such that reduction in the number of active cylinders occurs when the load requirement placed on an engine falls below a predetermined value. Subsequently, as the load requirement placed on the engine increases above another predetermined value, the inactive cylinders may be reactivated to provide the necessary energy to the engine. By reducing the number of active cylinders during low load conditions, the amount of fuel consumed may be reduced. A controller, such as an on-board computer, typically monitors the engine load and selectively shuts down one or more banks of cylinders when the engine load drops below the threshold level.

Figure 2:
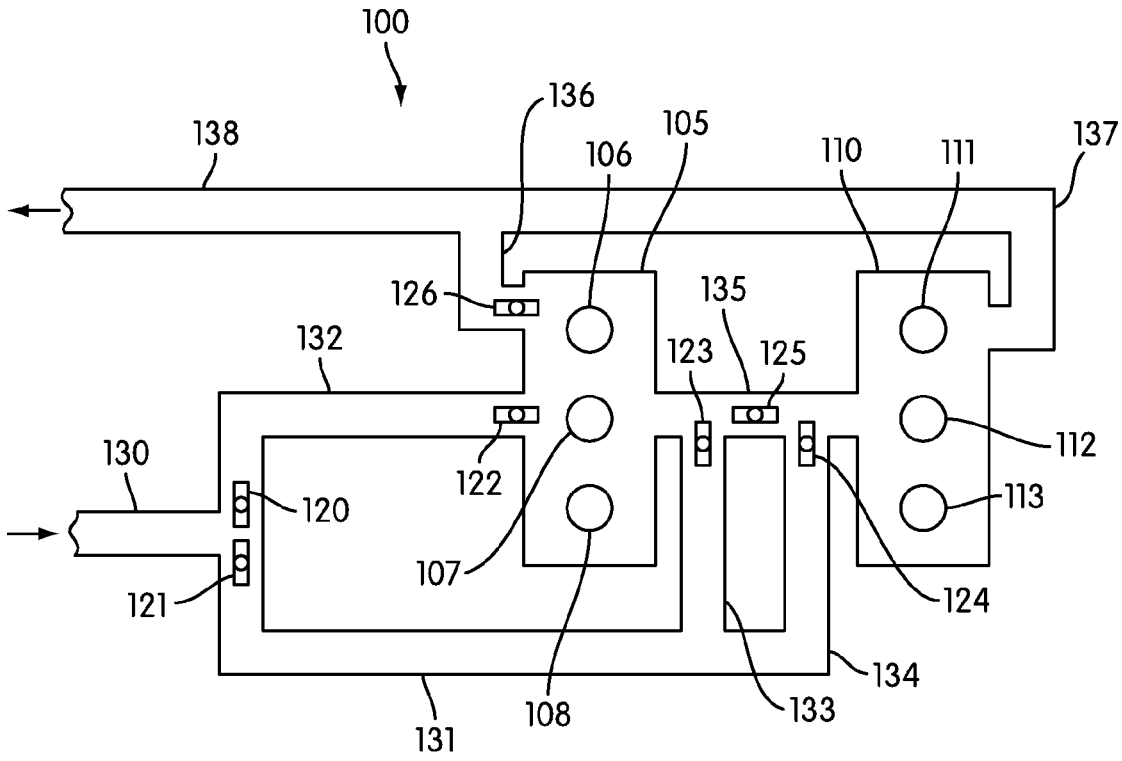
FIG. 2 is a schematic of a heating and cooling system for a variable cylinder engine.
Figure 3:
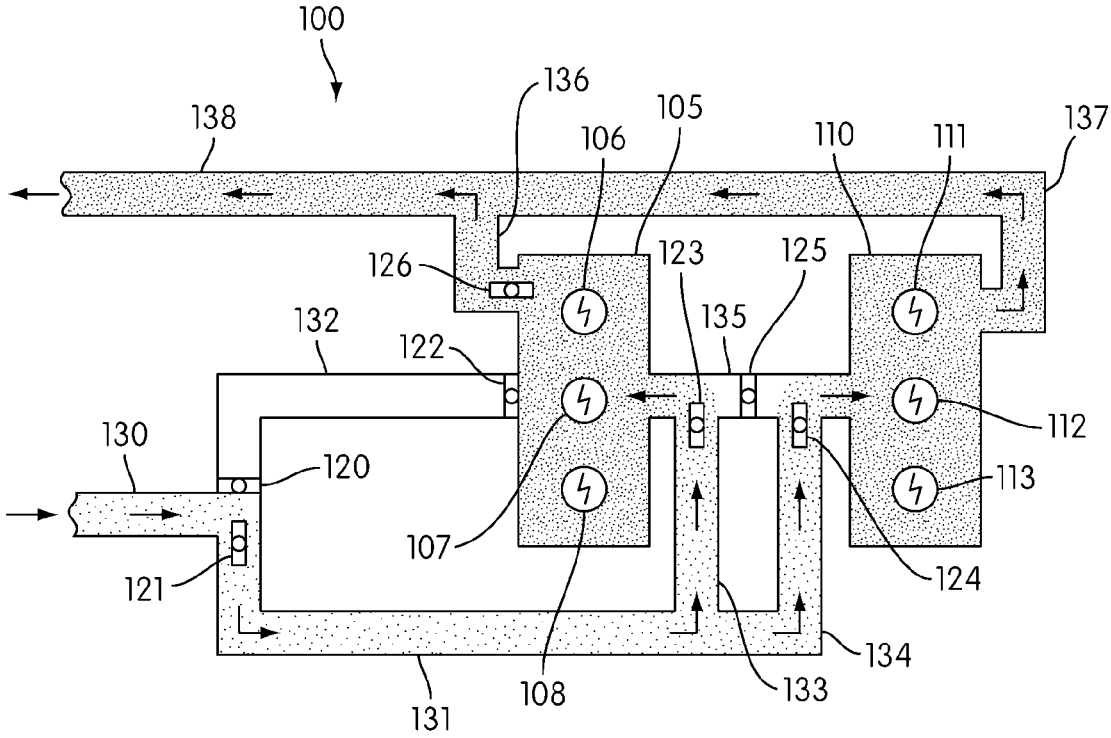
FIG. 3 is a schematic of a heating and cooling system for a variable cylinder engine during full operation.
Figure 4:
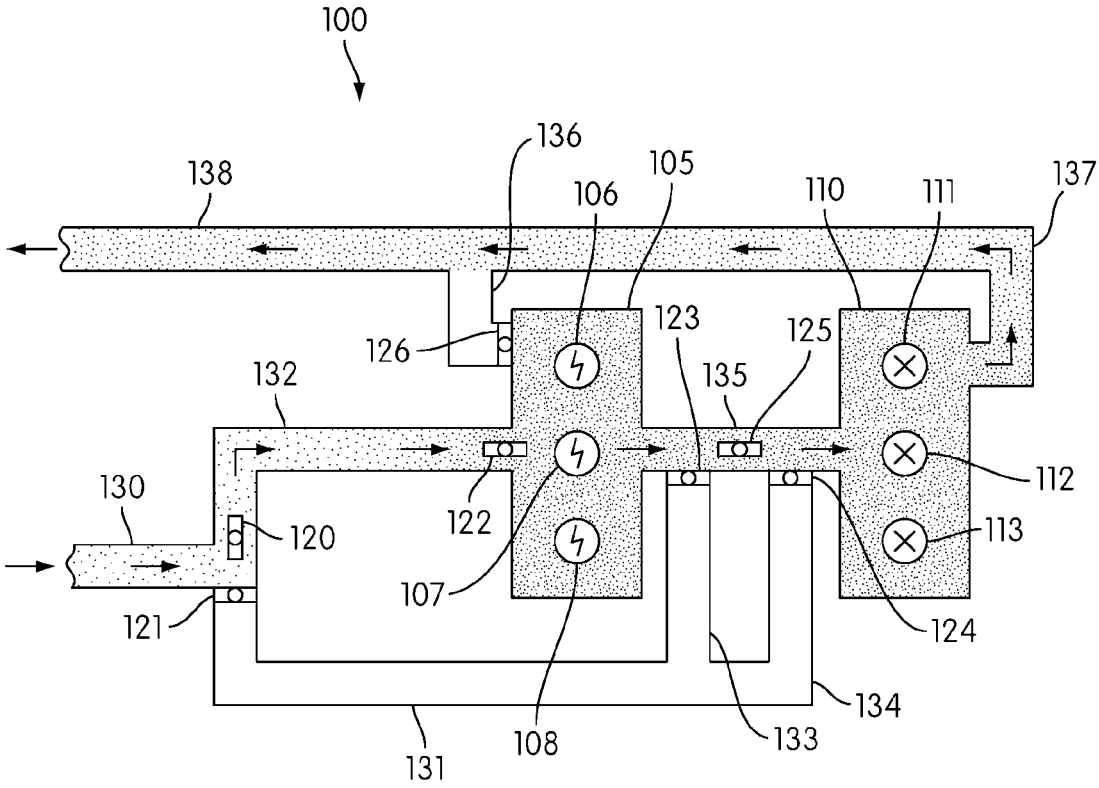
FIG. 4 is a schematic of a heating and cooling system for a variable cylinder engine during low load operation.

As shown in FIGS. 2-4, engine 20 is configured as a variable cylinder engine comprising a first cylinder bank 105 and a second cylinder bank 110. First cylinder bank 105 may include first cylinder 106, second cylinder 107 and third cylinder 108. Additionally, second cylinder bank 110 may include fourth cylinder 111, fifth cylinder 112, and sixth cylinder 113. Engine 20 may be configured such that fourth cylinder 111, fifth cylinder 112, and sixth cylinder 113 disposed within second cylinder bank 110 become inactive during reduced displacement operation of engine 20.

In some embodiments, heating and cooling system 30 is configured for a variable cylinder engine such that it provides both parallel and series cooling, depending upon whether all banks of cylinders are firing or if one or more banks of cylinders are inactive. FIG. 2 is a schematic diagram of one embodiment of engine 20 as a V6 cylinder engine connected to heating and cooling circuit 100.

Generally, heating and cooling circuit 100 distributes engine coolant to first cylinder bank 105 and second cylinder bank 110. In one embodiment, heating and cooling circuit 100 provides a means for distributing engine coolant in parallel. In some embodiments, parallel cooling circuits provide coolant simultaneously to first cylinder bank 105 and second cylinder bank 110. Heating and cooling circuit 100 may also be capable of distributing coolant in series, initially to first cylinder bank 105 followed by second cylinder bank 110. The selection of the parallel cooling flowpath or the series cooling flowpath may be dynamically controlled. In some cases, a system of valves may be used.

Generally, heating and cooling circuit 100 distributes engine coolant to the cylinders using a series of conduits that surround and/or are situated in close proximity to the cylinders and a pump. The conduits used and described herein are generally standard automotive cooling system conduits, such as stainless steel or aluminum pipes. Heating and cooling circuit 100 may include a first conduit 130 for distributing engine coolant from radiator 35 to engine 20. Second conduit 131 and third conduit 132 are in fluid communication with first conduit 130 to allow flow of engine coolant through different cooling circuits through engine 20. Third conduit 132 and fourth conduit 133 deliver engine coolant to first cylinder bank 105.

A fifth conduit 134 is in fluid communication with second conduit 131 to allow engine coolant flow to second cylinder bank 110. Additionally, a sixth conduit 135 allows engine coolant to flow from first cylinder bank 105 to second cylinder bank 110. A seventh conduit 136 distributes engine coolant from first cylinder bank 105 to return conduit 138. Additionally, an eighth conduit 137 distributes engine coolant from second cylinder bank 110 to return conduit 138. Return conduit 138 then returns engine coolant to radiator 35.

In some embodiments, the control valves may be provided to dynamically select the flowpath for engine coolant flow. Control valves may selectively prohibit engine coolant flow to the conduits of cooling circuit 100 to provide either parallel or series cooling of separate engine banks. Control valves may be one-way valves, two-way valves, check valves, or other flow control valves known in the art. In some embodiments, the control valves are capable of being remotely controlled by a controller, such as an on-board computer, so that the controller can determine the presence of inactive cylinders, select parallel or series cooling, and open or close the appropriate valves to choose the desired flowpath. While any number of control valves may be provided to determine the precise flow path of coolant around the cylinders of an engine, in one embodiment, first control valve 120, second control valve 121, third control valve 122, fourth control valve 123, fifth control valve 124, sixth control valve 125, and seventh control valve 126 are provided.

In some embodiments, first control valve 120 provides a means for blocking engine coolant flow to third conduit 132, and second control valve 121 provides a means for blocking engine coolant flow through fourth second conduit 131. In the embodiment shown in the figures, first control valve 120 and second control valve 121 control which circuit engine coolant will follow.

Additional control valves are provided which define the engine coolant circuits. For example, third control valve 122 selectively opens and closes to control the flow of engine coolant through third conduit 132 to first cylinder bank 105. Similarly, fourth control valve 123 selectively opens and closes to control the flow of engine coolant through fourth conduit 133 to first cylinder bank 105. Additionally, fifth control valve 124 selectively opens and closes to control the flow of engine coolant through fifth conduit 134 to second cylinder bank 110. Sixth control valve 125 selectively opens and closes to control the flow of engine coolant through sixth conduit 135 to second cylinder bank 110. Seventh control valve 126 selectively opens and closes to control the flow of engine coolant from first cylinder bank 105 to return conduit 138.

Using this configuration of heating and cooling circuit 100, thermal regulation of a variable cylinder engine may be optimized through the use of the most efficient coolant circuit for a given engine operating condition. In other words, when all cylinders, first cylinder 106, second cylinder 107, third cylinder 108, fourth cylinder 111, fifth cylinder 112, and sixth cylinder 113, are firing, cooling circuit 100 may be configured so that first cylinder bank 105 and second cylinder bank 110 are cooled in parallel. When fourth cylinder 111, fifth cylinder 112, and sixth cylinder 113 of second cylinder bank 110 are inactive due to low load conditions, the configuration of cooling circuit may be dynamically reconfigured to provide in series cooling of first cylinder bank 105 and second cylinder bank 110.

Heating and cooling circuit 100 may be configured to cool first cylinder bank 105 and second cylinder bank 110 in parallel during the full displacement configuration of engine 20. During the full displacement configuration, first cylinder 106, second cylinder 107, third cylinder 108 disposed within first cylinder bank 105 and fourth cylinder 111, fifth cylinder 112, and sixth cylinder 113 disposed within second cylinder bank 110 are all actively firing. Referring to FIG. 3, heating and cooling circuit 100 may provide a means for distributing engine coolant to first cylinder bank 105 and second cylinder bank 110 in parallel via first conduit 130, second conduit 131, third conduit 133, and fourth conduit 134. For clarity, engine coolant flow is depicted in a speckle pattern with arrows indicating flow direction. Additionally, to illustrate the temperature of engine coolant, a less dense speckle pattern represents cooler temperatures than a more dense speckle pattern.

First conduit 130 provides a means for distributing engine coolant at a low temperature from radiator 35 to second conduit 131. Second control valve 121 may be configured to allow engine coolant to flow to second conduit 131. Additionally, first control valve 120 may close to seal third conduit 132 to prevent distribution of engine coolant to first cylinder bank 105 via third conduit 132.

Engine coolant may be distributed from second conduit 131 in equal parts to fourth conduit 133 and fifth conduit 134. Fourth control valve 123 and fifth control valve 124 may be configured to allow engine coolant to flow through fourth conduit 133 and fifth conduit 134. Fourth conduit 133 may provide a means for distributing engine coolant to first cylinder bank 105. Simultaneously, fifth conduit 134 may provide a means for distributing engine coolant to second cylinder bank 110.

Sixth control valve 125 closes sixth conduit 135 to prevent distribution of engine coolant from first cylinder bank 105 to second cylinder bank 110. Third control valve 122 may close third conduit 132 off to first cylinder bank 105 preventing engine coolant flow from first cylinder bank 105 to third conduit 132. As engine coolant passes through first cylinder bank 105 and second cylinder bank 110, heat is extracted from cylinders and is transferred to the engine coolant fluid.

Sixth conduit 136 and seventh conduit 137 are configured to transfer high temperature engine coolant to return conduit 138. Return conduit 138 is configured to return high temperature engine coolant to radiator 35 for cooling of engine coolant. Using this configuration, low temperature engine coolant is delivered simultaneously to first cylinder bank 105 and second cylinder bank 110 for optimal temperature regulation of full displacement engine operation.

Alternatively, heating and cooling circuit 100 may be configured to distribute engine coolant in series to first cylinder bank 105 and second cylinder bank 110 during the reduced displacement configuration of engine 20. During the reduced displacement configuration of engine 20, first cylinder 106, second cylinder 107, and third cylinder 108 of first cylinder bank 105 are actively firing, while fourth cylinder 111, fifth cylinder 112, and sixth cylinder 113 of second cylinder bank 110 are not firing. Referring to FIG. 4, heating and cooling circuit 100 may provide low temperature engine coolant to first cylinder bank 105 via first conduit 130 and third conduit 132. For clarity, engine coolant flow is depicted in a speckle pattern with arrows indicating flow direction. Additionally, to illustrate the temperature of engine coolant, a less dense speckle pattern represents cooler temperatures than a more dense speckle pattern.

In this embodiment, first conduit 130 distributes low temperature engine coolant from radiator 35 to third conduit 132. First control valve 120 may be opened to allow engine coolant to flow through third conduit 132. Second control valve 121 is closed to prevent distribution of coolant through second conduit 131 to fourth conduit 133. Low temperature engine coolant may be distributed from third conduit 132 to first cylinder bank 105. Additionally, third control valve 122 may be configured to allow engine coolant flow to first cylinder bank 105.

Subsequently, high temperature engine coolant is distributed from first cylinder bank 105 to inactive second cylinder bank 110 via sixth conduit 135. Sixth control valve 125 may be opened to allow engine coolant flow through sixth conduit 135. Similarly, fourth control valve 123 may be closed to prevent engine coolant from flowing through sixth conduit 135 to fourth conduit 133. Fifth control valve 124 is closed to prevent engine coolant from flowing from sixth conduit 135 to fifth conduit 134. Fourth control valve 123 and fifth control valve 124 may also be closed to facilitate distribution of engine coolant through sixth conduit 135.

Seventh control valve 126 is also closed to prevent engine coolant from flow flowing from first cylinder bank 105 to return conduit 138. Eighth conduit 137 transfers high temperature engine coolant to return conduit 138. Return conduit 138 returns high temperature engine coolant to radiator 35.

As low temperature engine coolant is distributed to active first cylinder bank 105, engine coolant may cool active first cylinder bank 105. Heat may be extracted from first cylinder bank 105 and transferred to engine coolant causing the temperature of engine coolant to increase. As second cylinder bank 110 remains inactive, the temperature of fourth cylinder 111, fifth cylinder 112, and sixth cylinder 113 will decrease. Over time, the engine coolant becomes warmer than inactive second cylinder bank 110 due to heat transfer from first cylinder bank 105. Consequently, engine coolant transfers heat to second cylinder bank 110 as it is circulated around second cylinder bank 110. Using this configuration, second cylinder bank 110 remains at an elevated temperature during the inactive state.

The elevated temperature of second cylinder bank 110 may allow a quick restoration of stable combustion within fourth cylinder 111, fifth cylinder 112, and sixth cylinder 113 upon return to the full displacement configuration of engine 20. Additionally, the elevated temperature of second cylinder bank 110 maintains the temperature of the exhaust distributed to catalytic converter 45 to be at temperatures sufficient to maintain the optimal operation temperature of catalytic converter 45.

Figure 5:
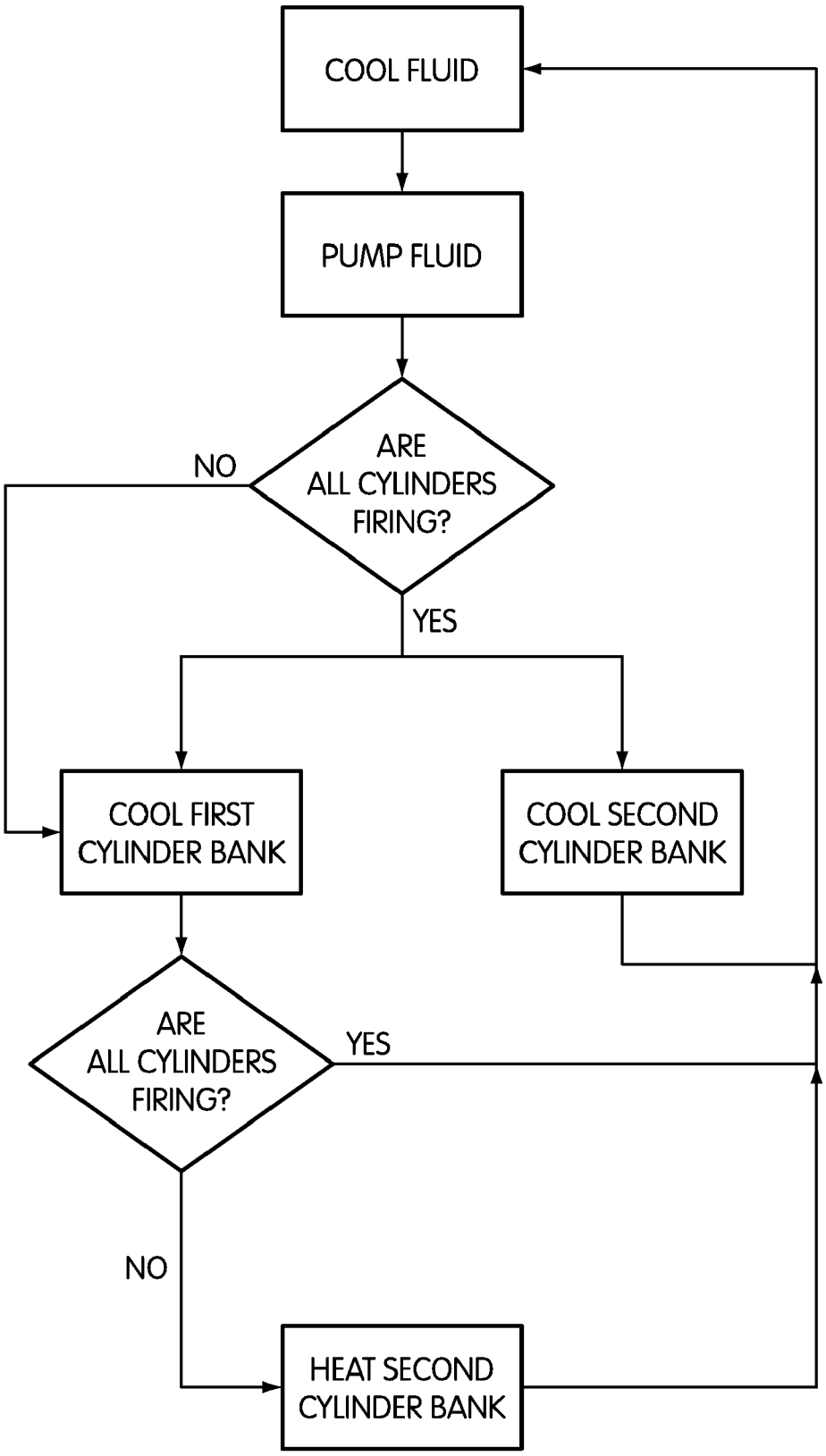
FIG. 5 is a flow chart illustrating a method for synchronizing heating and cooling of an internal combustion engine with engine displacement.

Operation of cooling system 30 in an efficient manner requires synchronization with the operational displacement configuration of engine 20. FIG. 5 is a flow diagram representing an embodiment of a method 500 for use of cooling system 30. Initially, in step 502, engine coolant fluid is cooled, such as by radiator 45. In step 504, coolant is subsequently pumped from radiator 45 into engine 20. In step 506, a determination is made as to whether or not all cylinders are firing. As discussed above, this determination may be made by an on board computer. If fewer than all cylinders are firing, then step 508 is performed. Step 508 entails cooling the cylinders in series. In one embodiment, as described above, step 508 may include manipulating the control valves of circuit 100 to form a series cooling flowpath. If all cylinders are firing, then step 510, cooling the cylinders in parallel is performed. In one embodiment, as described above, step 510 may include manipulating the control valves of circuit 100 to form a parallel cooling flowpath.

Among other advantages of the system, when the flow switches from parallel to series cooling, the flow rate will double to the actively firing set of cylinders. This increases the heat transfer from the actively firing set of cylinders, cooling the actively firing set of cylinders more rapidly. Consequently, the ignition timing of the engine may be advanced by setting the engine knocking ignition timing to a higher rate. Output power of the engine is, therefore, increased.

Another advantage of the system is that transferring heat from the active set of cylinders to the inactive set of cylinders makes the temperature of the cylinder block more uniform. This uniformity of temperature lowers the distortion of the cylinder block. This uniformity also reduces engine friction, since the inactive set of cylinder are hotter than in conventional systems.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A cooling system for an internal combustion engine having a plurality of engine cylinders, comprising:

a cooling circuit that includes:

a first flowpath for transferring a coolant to a first set of the engine cylinders and a second set of the engine cylinders in parallel, and a second flowpath for transferring the coolant to the first set of the engine cylinders and then to the second set of engine cylinders in series; and a controller that determines whether the plurality of engine cylinders includes inactive cylinders, wherein the controller selects the first flowpath when the engine is operating at full displacement and wherein the controller selects the second flowpath when the inactive cylinders have been detected.

2. The cooling system of claim 1, wherein the plurality of cylinders are oriented in a straight line relative to each other.

3. The cooling system according to claim 1, the cooling circuit comprising a system of fluidly connected conduits and a plurality of control valves capable of switching between either the first flowpath or the second flowpath.

4. The cooling system according to claim 3, wherein the internal combustion engine is a variable cylinder engine.

5. The cooling system according to claim 4, wherein the variable cylinder engine is a V-type engine.

6. The cooling system according to claim 4, wherein the second flowpath is selected when the second set of cylinders is inactive.

7. The cooling system according to claim 4, further comprising a radiator for removing heat from the coolant, wherein the cooling circuit transfers the engine coolant from the engine cylinders to the radiator, and wherein the first and second flowpaths are formed by a series of conduits in fluid communication, and wherein the controller controls a control valve to direct the coolant through either the first flowpath or through the second flowpath.

8. A cooling system for a variable cylinder engine, comprising:

a radiator for removing heat from the cooling system;

a system of conduits in fluid communication for circulating an engine coolant to and from the radiator to a plurality of engine cylinders;

the system of conduits forming a first cooling circuit and a second cooling circuit:

wherein the first cooling circuit cools the plurality of engine cylinders in parallel;

wherein the second cooling circuit cools a first set of the plurality of cylinders prior to heating a second set of the plurality of cylinders when the second set of cylinders are inactive;

a controller that determines whether the plurality of engine cylinders includes inactive cylinders, wherein the controller selects the first flowpath when the engine is operating at full displacement and wherein the controller selects the second flowpath when the inactive cylinders have been detected;

a control valve to direct the engine coolant to flow through either the first cooling circuit or through the second cooling circuit depending on a displacement state of the variable cylinder engine;

wherein the engine coolant flows through an outlet of the first set of cylinders and then through an inlet of the second set of cylinders in series when the control valve directs the engine coolant to flow through the second cooling circuit.

9. The cooling system according to claim 8, the controller comprising an on board computer of a motor vehicle.

10. The cooling system according to claim 1, wherein the displacement of the engine is based on an engine load.

11. The cooling system of claim 10, wherein the second set of cylinders is inactive.

12. The cooling system according to claim 11, wherein the plurality of cylinders are oriented in a straight line relative to each other.

13. The cooling system according to claim 8, wherein the second cooling circuit flows all coolant from the first set of cylinders to the second set of cylinders so that the second set of cylinders is heated and maintains an exhaust temperature of an exhaust produced by the first set of cylinders at levels sufficient to maintain catalytic conversion of the exhaust.

14. The cooling system according to claim 8, wherein the second cooling circuit flows all coolant from the first set of cylinders to the second set of cylinders so that the second set of cylinders is heated and maintains a cylinder temperature of the second set of cylinders at levels sufficient for efficient reactivation of the second set of cylinders.

15. The cooling system of claim 8, the variable cylinder engine being a v-type engine

16. The cooling system according to claim 8, wherein the displacement of the engine is based on an engine load.

17. A method for cooling an internal combustion engine having a plurality of cylinders comprising:

(i) a controller determining if all of the cylinders are firing;

(ii) the controller selecting a parallel cooling flowpath for all or substantially all of the cylinders if all of the cylinders are firing; and (iii) the controller selecting an in series cooling flowpath so that a first set of cylinders is cooled with an engine coolant prior to a second set of cylinders being cooled with the engine coolant if fewer than all cylinders are firing;

wherein the controller controls the flow of engine coolant so that the engine coolant passes through the first set of cylinders and then through the second set of cylinders in the in series cooling flowpath before entering a return conduit.

18. The method for cooling according to claim 17, wherein the parallel cooling flowpath and the in series cooling flowpath are selected by the controller manipulating a plurality of control valves disposed within a system of fluidly connected conduits, wherein the system of fluidly connected conduits containing both the parallel cooling flowpath and the in series cooling flowpath.

19. The method for cooling according to claim 18, wherein a displacement of the engine is based on an engine load.

20. the method for cooling according to claim 19, the controller comprising an On board computer of a motor vehicle.

* * * * *